United States Patent [19]

Davis

[11] 4,306,625

[45] Dec. 22, 1981

[54] BLADE AND FRAME ASSEMBLY FOR POWER MACHINES

[76] Inventor: Darrel B. Davis, Rt. 4, Box 539, Sequim, Wash. 98382

[21] Appl. No.: 37,745

[22] Filed: May 10, 1979

[51] Int. Cl.[3] ..... E02F 3/76

[52] U.S. Cl. ..... 172/819; 172/701.1

[58] Field of Search ..... 172/801–809, 172/788, 789, 795, 741

[56] References Cited

U.S. PATENT DOCUMENTS

| | | | |
|---|---|---|---|
| 2,134,019 | 10/1938 | Allin | 172/801 |
| 2,374,016 | 4/1945 | Henneuse | 172/804 |
| 2,565,337 | 8/1951 | Allan | 172/804 |
| 2,967,364 | 1/1961 | Warner | 172/805 |
| 3,002,300 | 10/1961 | Turbyfill | 172/804 |
| 3,670,825 | 6/1972 | Asal | 172/804 |
| 3,757,438 | 9/1973 | Watase | 172/801 |
| 3,759,110 | 9/1973 | Davis | 172/805 |
| 3,914,064 | 10/1975 | Gurries | 404/84 |

*Primary Examiner*—Richard J. Johnson
*Attorney, Agent, or Firm*—William I. Beach

[57] ABSTRACT

An improved blade and frame assembly have a pair of laterally rotating arms disposed between a blade and a U-shaped frame rotatably connected to a power machine. The blade and frame are activated for vertical movement. Also included is a power source pivotally connected between the blade and frame for shifting the blade laterally at an angle to the draft of the machine.

9 Claims, 11 Drawing Figures

BLADE AND FRAME ASSEMBLY FOR POWER MACHINES

BACKGROUND OF THE INVENTION

1. Field of the Invention

The present invention relates to blade and frame assemblies for heavy power machines generally classified as bulldozers or roadgraders and more particularly the type known as a log skidder which is used for clearing or thinning timber in logging operations.

2. Description of the Prior Art

The class of heavy power machines described above is equipped with a front mounted blade which is swung vertically on a framework rotatably connected to the machine. The bulldozer uses the blade primarily for moving dirt so as to level or fill land areas. The skidder is a multi-purpose machine designed for cutting roadways in heavy stands of timber, mostly in hills or mountainous terrain and dragging logs out of the woods through gullies, swampy areas and around trees or stumps. When the logs are dragged or skidded to the roadside they are stacked in piles for loading onto logging trucks. For this type of work the skidder is constructed in two sections, a front drive section joined by a swivelling connection to an aft driving trailer section. A narrow blade is connected to a pair of elongated arms which is rotatably mounted at their distal ends on the front section adjacent to the operator's compartment. The blade is operated for movement in a vertical direction. A powerful winch mounted on the trailer has a brake drum for handling one or more steel cables. The cables are wrapped around several logs and skidded out of the trees, stumps and the like to a road previously cut and leveled by the same skidder. Skidding logs out of a thinned woods is a difficult task for the operator of a skidder for he is seldom permitted to turn the machine around among trees and stumps or to skid logs in a straight path to the road. The skidder blade being supported in front between the two front wheels will not clear some trees and makes it necessary to back up and reposition the machine several times. This will happen in spite of the fact that with a swivelling trailer and capability of virtually bending the skidder in an L-shape around a tree, the tree may be lodged in front of or between the blade and the framework and prevent the machine from getting free. When this occurs the tree has to be cut down involving a considerable loss of operational time. Another problem similar to this happens when a skidder slides sideways down a hill and catches a tree behind the blade. Again in this situation it is required to cut the tree down to free the machine. Yet another problem occurs when the skidder is required to use the blade to cut a roadway in the woods along a steep hillside. This becomes a very difficult task inasmuch as the narrow blade lays inside of the front tires whereupon the high side tire behind the blade rides on the upper portion of the bank and tilts the machine making it difficult to cut a level path. Preferably, the length of the blade is less than the width of the outside edge of the front tires by approximately the width of one tire. There is a daily problem with the conventional skidder blade where it is used to stack logs along the roadside. When the skidder has hauled logs to the roadside the machine is positioned so that the blade is parallel to the log to be lifted. If the blade is not positioned right the log is not balanced and the heavy or butt end will remain on the ground while the light end will swing up over the pile of logs. Then the operator will have to drop the log and reposition the machine and blade as many times as is necessary to lift it to the top of the pile.

In light of the foregoing description of the difficult problems occurring with the existing blade arrangement on the log skidder it is the object of the present invention to provide a laterally adjustable blade and frame which will solve these problems. The present invention can be manufactured inexpensively and is readily adaptable for installation on skidders and heavy equipment used in similar work.

SUMMARY OF THE INVENTION

In carrying out the principles of the present invention in accordance with a preferred embodiment thereof, an improved laterally adjustable blade and frame assembly is provided for power machines. A blade is mounted forwardly on a power activated frame which is pivotally connected to the machine and with which the blade is used for stacking logs, cutting roadways in steep hillsides and the like. The improvement comprises an arcuate blade, supported between the front tires of the machine, and a pair of spaced arms extending forwardly of the frame in which the rear ends are pivotally connected to the frame and forward ends pivotally connected to the blade. There are means for connecting the arms to the blade and frame operating in cooperation with pivotal movement of said arms, as well as means associated with the frame which can apply pressure on the blade to shift it angularly in a lateral direction with the draft of the machine.

DETAILED DESCRIPTION

Figure 1:
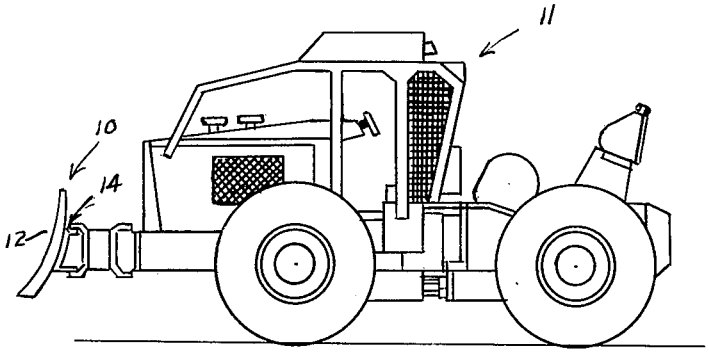
FIG. 1 discloses a side elevational view of a blade and frame assembly connected to a power machine.
Figure 2:
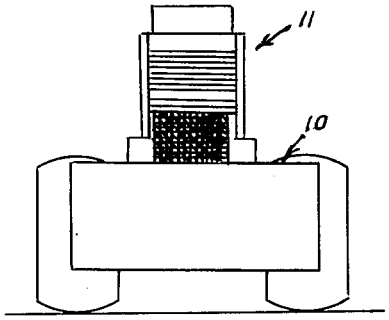
FIG. 2 is a front elevational view of the blade and power machine.
Figure 3:
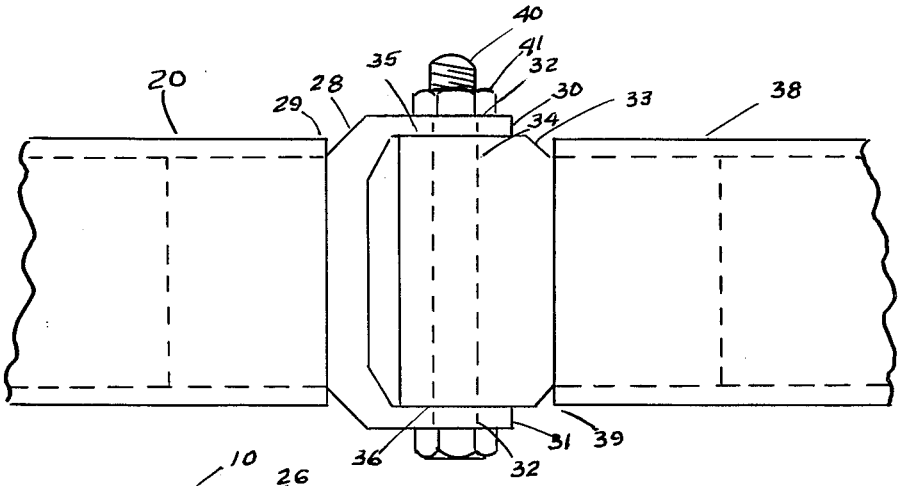
FIG. 3 is an enlarged view of the means for pivotally connecting the arms to the blade and frame.
Figure 4:
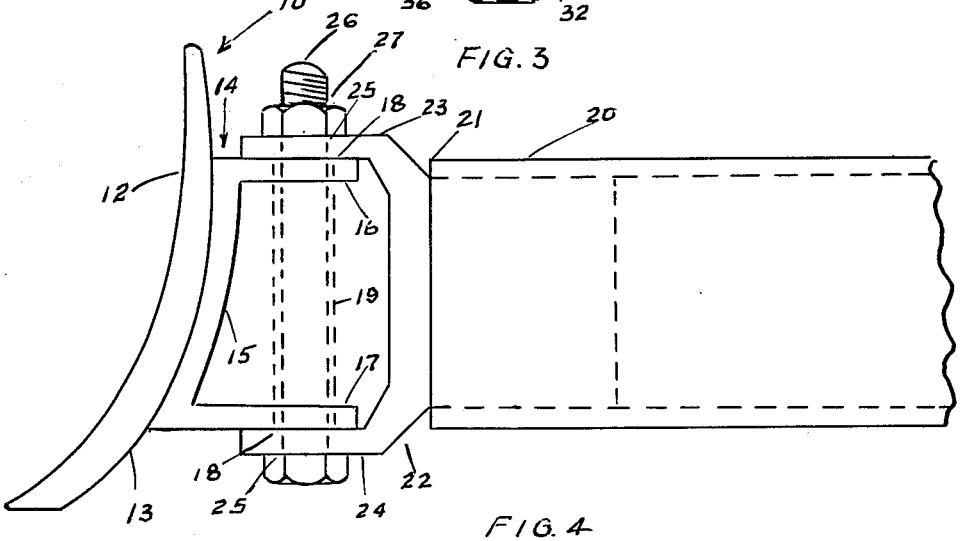
FIG. 4 is an enlarged view of the means for pivotally connecting the arms to the blade.
Figure 5:
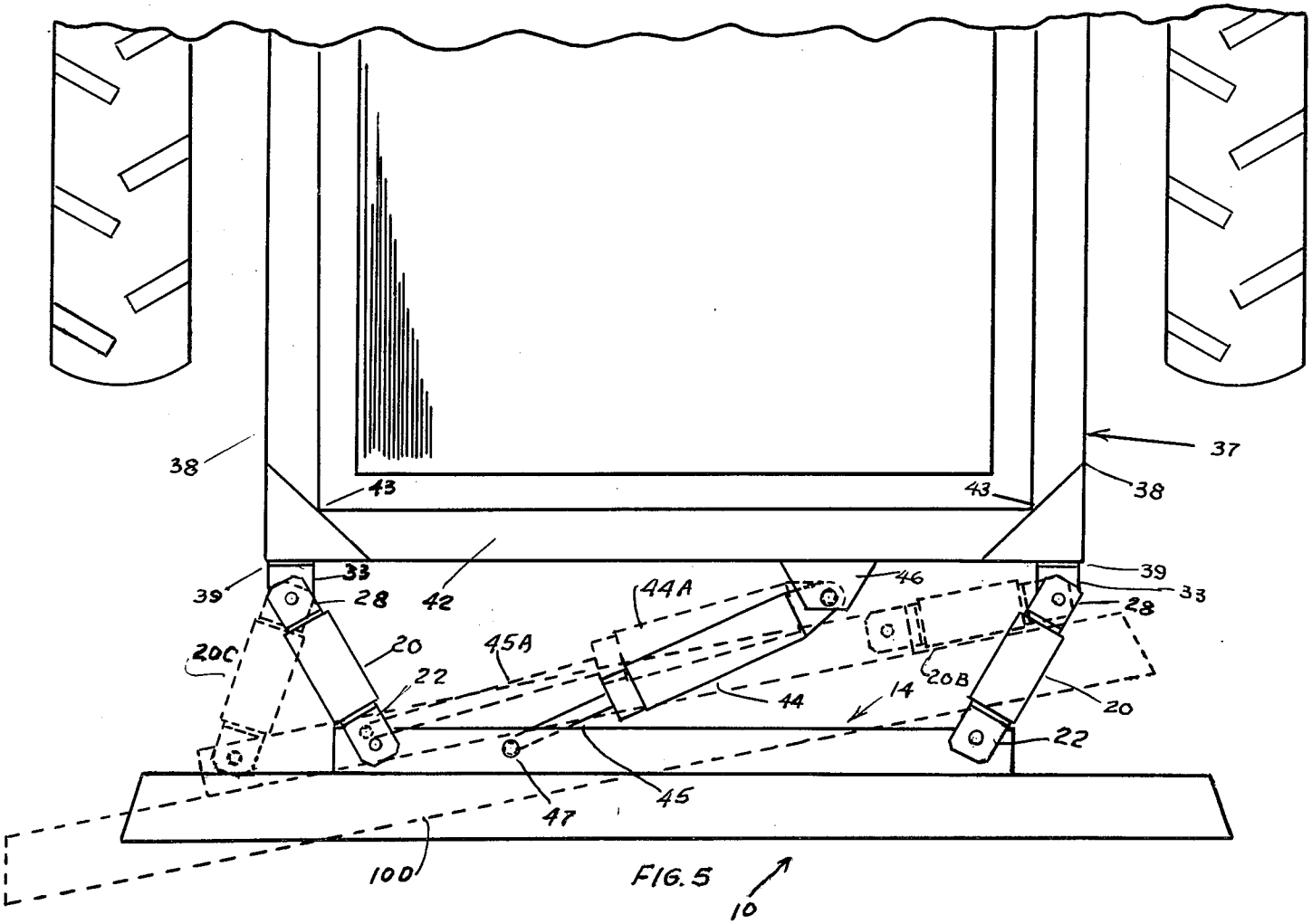
FIG. 5 is an enlarged fragmented plan view of the blade and frame assembly disclosing the pivotal arms and actuating device for shifting the blade in a lateral direction, FIG. 6 discloses a plan view of the blade of a machine blocked by a tree in turning the machine around in the woods, FIG. 7 discloses a plan view of the machine in FIG. 6 with the blade shifted laterally to the left to disengage the blade from the tree, FIG. 8 discloses a plan view of the machine cutting a roadway with the tire riding on the bank of the hillside, FIG. 9 discloses a plan view of the machine of FIG. 8 with the blade extended to the side cutting a ledge for the tire on which to ride.

Referring to FIGS. 1 and 2 it can be seen that a blade 10 is mounted on the front end of a power machine 11 of a type known in the wood industry as a log skidder. Referring also to FIGS. 3, 4, and 5, blade 10 has an arcuate front surface 12 and rear surface 13. An elongated channel 14 is mounted on the rear surface 13 of blade 10. Channel 14 has a vertical back plate 15 generally formed to the rear surface 13 and can be attached thereto with bolts. It is perferable, however, to attach the channel to blade 10 by welding techniques. The upper horizontal flange plate 16 and lower plate 17 of channel 14 have a pair of spaced holes 18 extending in vertical alignment through the upper and lower flanges 16 and 17 adjacent to the distal ends of channel 14. A channel stiffening member comprising a tubular spacer 19 having the same diameter bore as holes 18 is secured between the flange plates in alignment with the said holes.

A pair of relatively short spaced arms 20 constructed in the shape of a hollow rectangular beam is pivotally connected to blade 10. From the forward end 21 of each arm extends a clevis member 22 which has an upper horizontal leg 23 and a lower leg 24. A hole 25 extends in alignment through the upper and lower legs. The legs 23 and 24 respectively are pivotally connected to upper and lower flange plates 16 and 17 of channel 14 so that the holes 25 in the legs of the clevis are in proper alignment with the holes 18 in the flange plates of the channel. A tie bolt 26 is disposed in holes 18 and 25 which together with nut 27 threadedly engaged therewith serve to cinch legs 23 and 24 in pivotal relationship with upper and lower flange plates 16 and 17 of channel 14. Another similar clevis member 28 extends from the rear end 29 of each arm 20 and likewise has an upper and lower leg 30 and 31 respectively. Likewise, clevis 28 has a vertically extending hole 32 through legs 30 and 31. The clevis 28 in the rear end 29 of arm 20 is pivotally connected to a bolt-receiving body 33 which has a vertical hole 34 extending through upper and lower horizontal surfaces 35 and 36, fixedly attached to the front end of U-shaped frame 37 shown in FIG. 5.

Referring again to FIGS. 3 and 5 it is seen that frame 37 has a pair of elongated spaced arms 38 which has bolt-receiving body 33 extending from each open end 39. Similarly to the pivotal connection of clevis 22 of arms 20 to channel 14, the upper and lower legs 30 and 31 are pivotally connected to upper and lower surfaces 35 and 36 of bolt receiving body 33. A bolt 40 extends through holes 32 and 34 and together with nut 41 cinch the legs of clevis 28 to bolt-receiving body 33 of frame 37.

Arms 38 of frame 37 are also hollow rectangular beams rotatably mounted at their rear ends to power machine 11 adjacent to the operator's compartment. The front end of arms 38 are joined together in parallel relationship by cross member 42, reference FIG. 5. The juncture of cross member 42 to arms 38 is secured by upper and lower gusset plates 43. The rigidity and strength of frame 37 together with the connection of arms 20 to blade 10 is more than adequate to support vertical and end loads customarily applied on blade 10.

A further addition to the above related structure is a hydraulic cylinder 44 having a reciprocating shaft 45 is disposed diagonally between cross member 42 of frame 37 and channel 14 of blade 10. The rear flange of cylinder 44 is pivotally connected to fitting 46 attached to the forward side of cross member 42. The front flange of the cylinder is pivotally connected to an upright support member 47 intermediate flanges 16 and 17 of channel 14. The means for fastening cylinder 44 to channel 14 and cross member 42 is conventional and not discussed herein.

Figure 6:
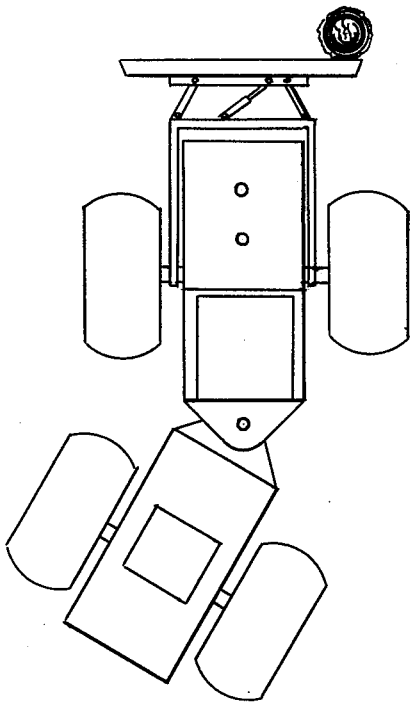
Figure 7:
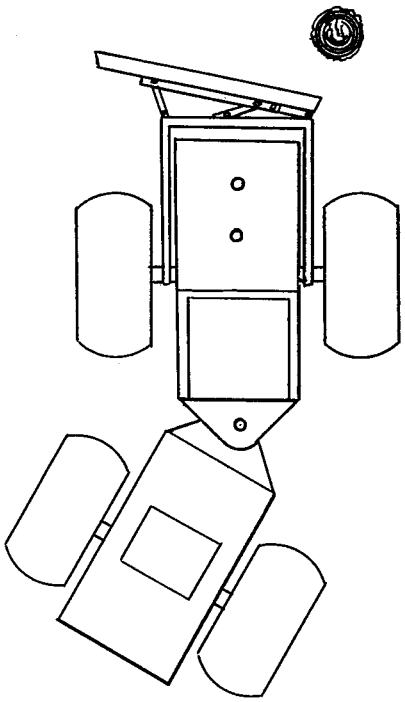

In operating the present invention reference is made to FIG. 5 through FIG. 11. FIG. 6 shows a power machine such as the skidder blocked from turning around by a tree pressed against the right side edge of blade 10. Since the standard blade installation on a skidder can only move up and down in a vertical direction the operator is compelled to back up and try to pass the tree or get out and cut it down. This conditions occurs quite often in the woods and a considerable amount of time is lost in the job of thinning or clearing an area of trees.

However, the present invention solves this problem in that the operator, without leaving his seat, can shift blade 10 in a lateral direction to the opposite side of the machine to or slightly beyond the outside edge of the front tire. In almost all such conditions the blade in sliding angularly away from the tree frees the blade so that the turn can be made. When the operator wants to shift the blade laterally the cylinder 44 positioned between blade 10 and the frame 37 is activated to withdraw or extend the cylinder shaft. In the case illustrated in FIG. 7 the shaft is withdrawn within the barrel of the cylinder to start blade 10 moving towards the left hand side of machine 11. The extent of the lateral and angular movement of blade 10 is predetermined and controlled by the length of arms 20, location of cylinder 44 with respect to frame 37 and blade 10 and the arc of the cylinder stroke. For example, when the cylinder shaft 45 is withdrawn towards frame 37, cylinder 44 and arms 20 move through respective arcs towards the left hand side of the machine. Blade 10 then is drawn to the left hand side, thus forcing the right hand end or tip of the blade to move inwardly toward frame 37 and extending the left hand tip outwardly past the side of the left hand tire. The blade fully extended laterally forms a sliding angle when dodging trees, moving dirt or stacking logs. It is obvious from the mechanical arrangement of blade 10, arms 20, frame 37 and cylinder 44 as shown in FIG. 5 that blade 10 can be shifted to either side of machine 11 with the leading tip of the blade always pointing away from frame 37 and the trailing end towards the frame.

Figure 8:
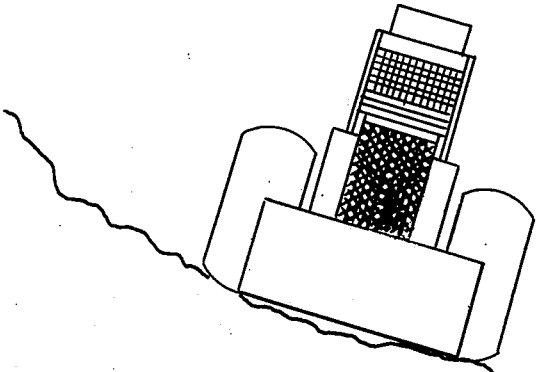

FIG. 8 discloses another situation where the skidder is required to cut a roadway in a hillside. In view of the problem of maneuvering a skidder through and around trees, stumps, brush and other obstacles in the woods the length of the standard skidder blade is confined within the track of the front tires to prevent the tip of the blade from catching on stumps and piles of underbrush when the front tires ride over or around such obstacles. Unfortunately, the standard blade being fixed inside of the front tires make it difficult to cut a level roadway in sloping ground. A typical case is where the lower right hand corner of the blade digs into the bank in front of the tire, but a portion of the tire being on the outside of the blade rides on the uncut portion of the hill and tilts the machine tending to prevent the blade from cutting a level path. Further, the blade being positioned normal to the draft of the machine piles up dirt in front rather than shoving it to the side out of the way.

Figure 9:
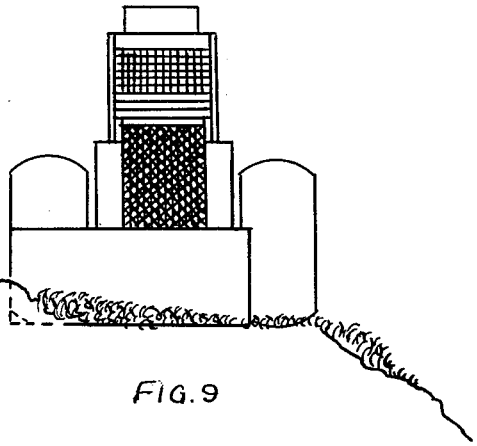

Referring to FIG. 9, it is seen that with blade 10 of the present invention shifted outwardly to the outside edge the side of the front tire the blade can scoop out a ledge of earth on which the tire can ride and not create a tilting effect on the machine. Therefore, while the first cuts or so of the blade may not dig out a level road repeated passes at the bank will do so. Further, the fact that the blade always thrusts forward at an angle to the path of cut the loose dirt is pushed off to the side downhill.

The kinematics of the operation for shifting blade 10 in the situation described above is shown in FIG. 5. When hydraulic cylinder 44 is activated so as to extend shaft 45 forwardly the cylinder arms and blade rotate in individual arcs to new positions as illustrated by dotted lines. It is to be seen that the position of arms 20 are shown as 20B and 20C respectively. The new position of cylinder 44 is shown as 44A and blade 10 as 10D. It is to be noted also that the right hand tip of blade 10D is extended beyond the outside edge of the right hand tire in position to cut a level path for the tire on which to ride.

Figure 10:
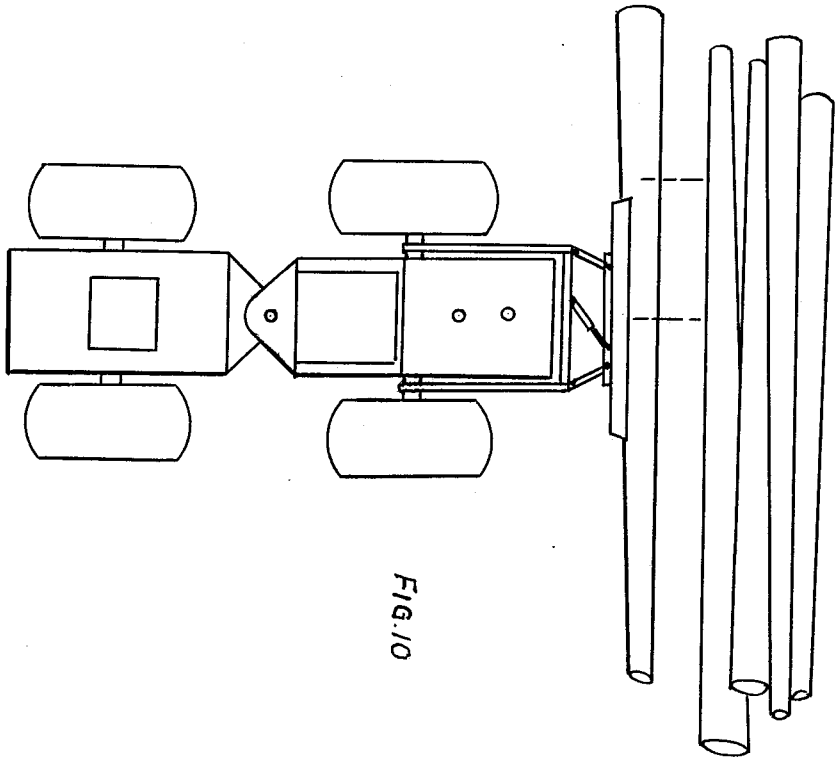
FIG. 10 discloses a plan view of the machine with the blade in contact with a log in an unbalanced position to lift it on top of a pile of logs, and FIG. 11 discloses a plan view of the machine in the same position but blade shifted laterally for contact with the log at a point where balance is obtained for stacking.

The most frequent problem encountered daily by the operator of a skidder is in using the blade to stack logs along the roadside. FIG. 10 discloses the position of the machine when using a blade to lift one or several logs onto a pile of logs. With the conventional skidder blade the operator attempts to apply the center of lifting effort of the blade at the approximate C.G. of the load for a balanced lift. Failing to do this, the light end of the log will start to lift up over the pile while the butt or heavy end will remain on the ground. Unfortunately, the operator may have to back up and reposition the blade several times before the center of effort of the blade is aligned near or at the C.G. of the log to lift a balanced load.

Figure 11:
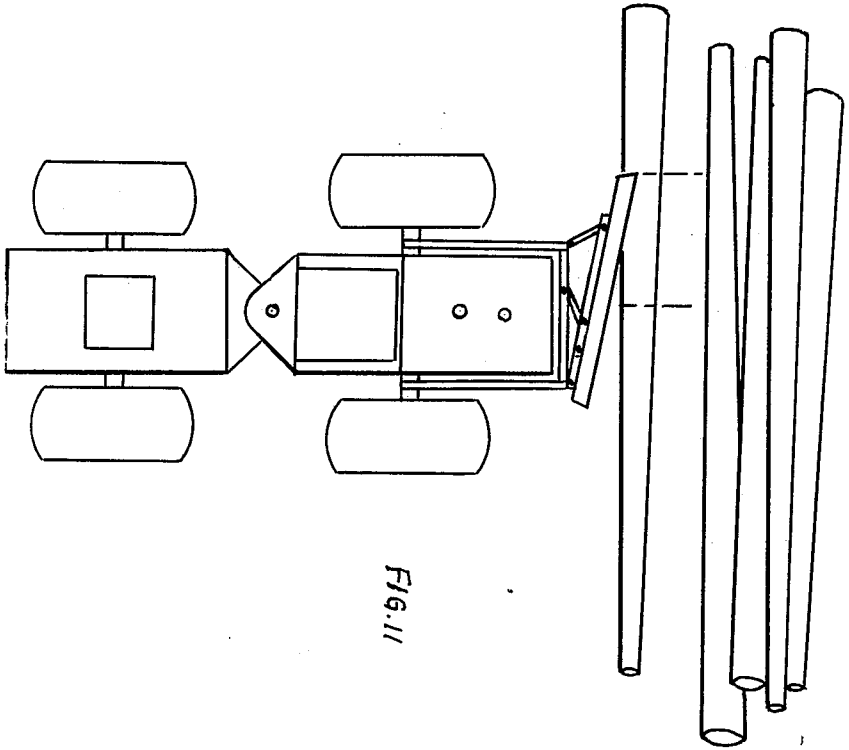

The advantage of being able to position the machine once only to lift a balanced load is disclosed in FIG. 11. Here the operator can shift the blade from side to side using the tip of the blade 10 to reach the C.G. of the log without the necessity of backing up to reposition the machine. With tip in contact at the C.G. of a balanced load the log is lifted or rolled onto the pile of logs.

From the description and illustration of the present invention it is obvious that it provides many important advantages which can be utilized effectively to increase the efficiency of the log skidder.

The foregoing description is to be clearly understood to be given by way of illustration and example only; that the spirit and scope of the present invention is limited solely by the appended claims.

I claim:

1. An improved laterally adjustable blade and frame assembly for power machines of the type having a blade mounted forwardly on a power activated frame pivotally connected thereon, and which the blade is used for stacking logs, cutting roadways in steep hillsides and the like, wherein the improvement comprises:

an arcuate blade having distal ends disposed inside of the outside edge of the front tires, an elongated channel having a three sided rectangular C-shaped section, the channel further having the longer upright leg transversely welded to the rear side of the blade and the shorter horizontal flanges bored for a pair of spaced apart holes extending in vertical alignment through the upper and lower flanges, a pair of spaced apart arms for supporting said blade having rear ends pivotally connected to the frame and front ends pivotally connected in the spaced holes in the upper and lower flanges of said channel, the arms being disposed so that the distance between said frame pivotal connections exceed the distance between said channel pivotal connections, means for pivotally connecting said arms to said frame and channel, and means pivotally connected to said frame and channel having reciprocating means adapted to urge said blade laterally and angularly on said arms, the angular displacement of said arms being sufficient to extend one tip end of said blade beyond the outside edge of a front tire.

2. An improved laterally adjustable blade and frame assembly as recited in claim 1, wherein the means pivotally connected to said frame and channel adapted to urge said blade laterally and angularly on said arms comprises:

a hydraulic actuator having a casing and a reciprocating shaft contained therein, the outer end of the shaft being adapted to apply diagonal pressure on said channel so that when extended a tip end of said blade moves laterally away from one side of said frame while the opposite tip moves inwardly and when said shaft is retracted said blade moves similarly on the other side.

3. An improved blade and frame assembly recited in claim 1, wherein:

said arms comprise a pair of hollow rectangular beams having openings at opposite ends thereof, said arms being of considerable less in length than said beams of said frame.

4. An improved blade and frame assembly recited in claim 1, wherein the means for connecting said arms to said frame and said blade comprises:

a bolt-receiving member, having parallel upper and lower surfaces including a vertical bore therethrough, extending outwardly from said forward ends of said frame, a clevis member, having a pair of aligned holes through upper and lower leg portions of the member, extending outwardly of opposite ends of said arms, and a bolt arrangement disposed in the holes of said channel, clevises and bolt-receiving members for connecting said clevises and said bolt-receiving member of said arms to said frame and blade.

5. An improved laterally adjustable blade and frame assembly for power machines of the type having a blade mounted forwardly on a power actuated frame pivotally connected thereon, and in which the blade is used for stacking logs, cutting roadways in steep hillsides and the like, wherein the improvement comprises:

a generally narrow arcuate blade, horizontally mounted, having the opposite tip ends of the blade disposed inside of the outside edge of the front tires, an elongated channel having a C-shaped section comprising an upright leg and a horizontal flange integrally connected to the distal ends of the leg, the channel further being transversely welded to the rear face of said blade and having the upper and lower flanges bored with a pair of spaced apart holes extending in vertical alignment therethrough, a pair of spaced apart arms having their rear ends pivotally connected adjacent to the opposite ends of said frame and front ends pivotally connected in the spaced apart holes in said channel flanges, the arms being extended to form a linkage with said frame and blade such that the distance between the frame pivotal connections exceed the distance between the channel pivotal connections of said blade, means for pivotally connecting the opposite ends of said arms to said frame and said channel of said blade, and means pivotally connected to said frame and channel comprising a linear actuator adapted to reciprocally urge said blade laterally in an angular direction on said arms and the resultant angular displacement of said arms being such that the tip end of said blade moves from inside of to beyond the outside edge of the front tires.

6. An improved blade and frame assembly as recited in claim 5 wherein the means pivotally connected to said frame and channel adapted to reciprocally urge said blade laterally in an angular direction on said arms comprises:

a hydraulic cylinder including a rod reciprocally projecting therefrom adapted when extended to shift said blade laterally such that the right hand tip moves outwardly and the left hand tip inwardly and when withdrawn the left hand tip moves outwardly and the right hand inwardly with respect to said frame.

7. An improved blade and frame assembly recited in claim 5, wherein:

the vertical leg of said channel is shaped to conform with the curvature of said blade.

8. An improved blade and frame assembly recited in claim 5 wherein:

said arms are constructed of hollow rectangular tubes having an optimum strength to weight ratio sufficient to support maximum loads applied on said blade.

9. An improved blade and frame assembly recited in claim 5, wherein:

a solid hinge member having parallel upper and lower surfaces bored for a vertical hole there through extends outwardly from the forward ends of said frame, a clevis member having an inner end portion secured within the opposite ends of said arms and the outer end portions bored with a hole in vertical alignment through the upper and lower legs of the clevis member, and a bolt arrangement disposed in the holes located in the channel flanges, clevis members and hinge members for pivotally connecting said arms to said channel and frame.

* * * * *